United States Patent [19]

Burke, Jr.

[11] 3,996,149

[45] Dec. 7, 1976

[54] DETERGENT COMPOSITIONS AND DETERGENT ADJUVANT COMBINATIONS THEREOF, AND PROCESSES FOR FORMING THE SAME

[76] Inventor: Oliver W. Burke, Jr., P.O. Box 2266, Fort Lauderdale, Fla. 33061

[22] Filed: Jan. 2, 1975

[21] Appl. No.: 538,209

Related U.S. Application Data

[63] Continuation-in-part of Ser. No. 184,059, Sept. 27, 1971, Pat. No. 3,886,079.

[52] U.S. Cl. ..... 252/160; 252/89 R; 252/131; 252/140

[51] Int. Cl.[2] ..... C11D 3/10; C11D 3/14; C11D 7/06; C11D 7/20

[58] Field of Search ..... 106/288 B; 423/339; 106/308; 252/116, 120, 128, 131, 140, 145, 163, 383, 385, 109, 89, 160

[56] References Cited

UNITED STATES PATENTS

| | | | |
|---|---|---|---|
| 2,730,507 | 1/1956 | Bradford | 252/109 |
| 2,776,943 | 1/1957 | Eaton | 252/109 |
| 3,172,726 | 3/1965 | Burke | 423/339 |
| 3,172,727 | 3/1965 | Burke | 423/339 |
| 3,281,210 | 10/1966 | Burke | 423/339 |
| 3,325,249 | 6/1967 | Burke | 423/339 |
| 3,630,919 | 12/1971 | Sheaffer | 252/88 |
| 3,630,929 | 12/1971 | Van Dijk | 252/136 |
| 3,708,428 | 1/1973 | MacDonald | 252/109 |
| 3,769,222 | 10/1973 | Yurko | 252/89 |
| 3,868,336 | 2/1975 | Mazzola | 252/527 |

*Primary Examiner*—Dennis L. Albrecht
*Attorney, Agent, or Firm*—Hall & Houghton

[57] ABSTRACT

Detergent compositions and detergent adjuvant combinations thereof and processes for forming the same are provided, the adjuvant combination being alkaline and comprising hydrated silica pigment precipitate and electrolyte, the electrolyte being selected in a controlled proportion from the class of alkali metal carbonates and/or bicarbonates, and the adjuvant being combined with soap and/or other anionic and/or nonionic detergents and/or polymeric emulsifiers in the composition. The silica pigment precipitate may be formed in the presence of the detergent, and detergent may be added to or be formed in the presence of the adjuvant combination. The products may be dried to form concentrated liquid, paste, bar, and powdered detergent compositions, the latter preferably being spray dried.

10 Claims, 1 Drawing Figure

PREPARATION OF DETERGENT ADJUVANT COMPOSITIONS
of Sodium Carbonate and/or Bicarbonate
and Hydrated Alkaline Silica Pigments
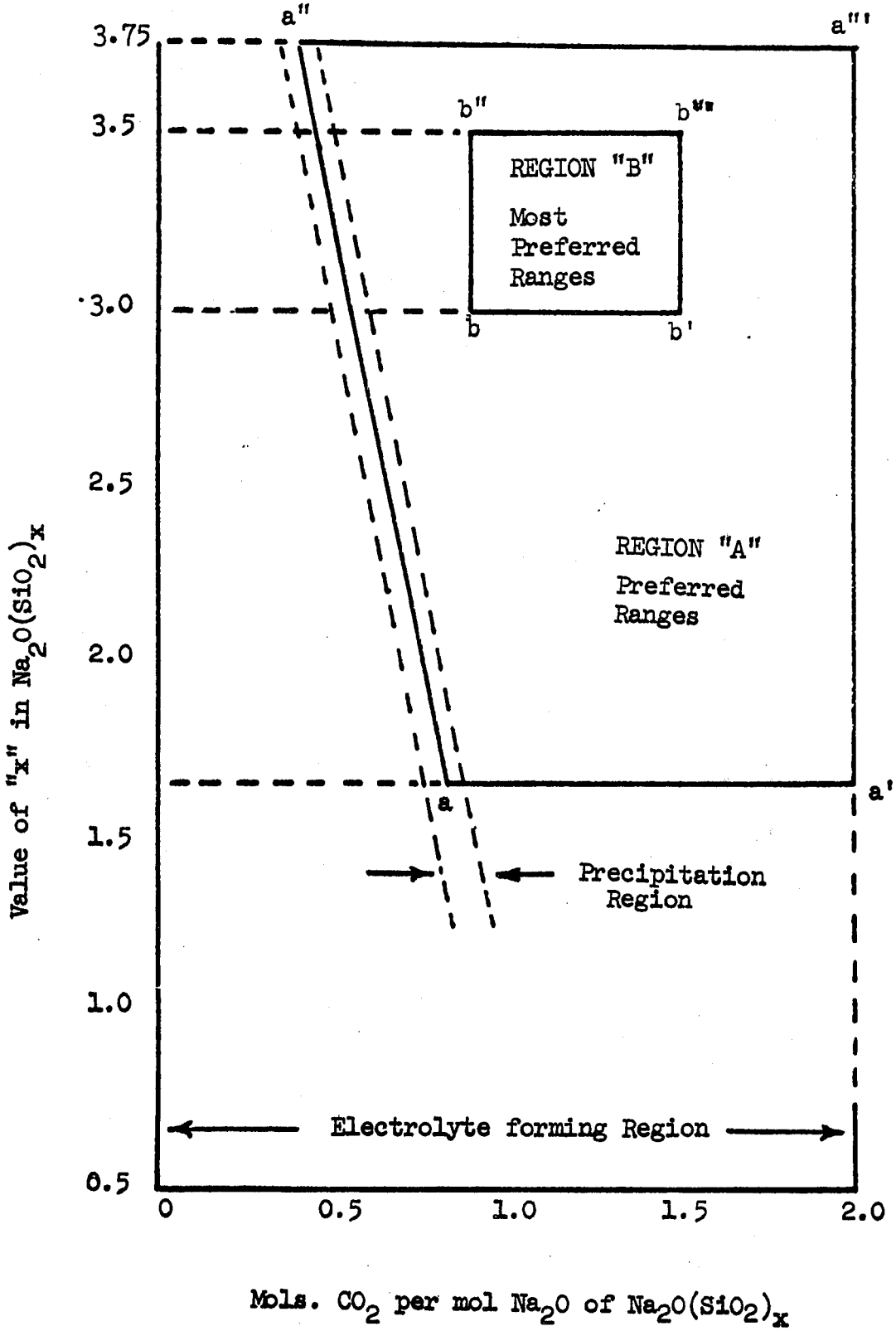

DETERGENT COMPOSITIONS AND DETERGENT ADJUVANT COMBINATIONS THEREOF, AND PROCESSES FOR FORMING THE SAME

CROSS REFERENCE TO RELATED APPLICATION

This application is a continuation-in-part of product subject matter divided from copending parent application Ser. No. 184,059 filed Sept. 27, 1971, now U.S. Pat. No. 3,886,079 and specifically claims product subject matter disclosed in said parent application, but not specifically claimed in said patent, i.e. the detergent adjuvant sub-combination of the product combination claimed therein.

BACKGROUND OF THE INVENTION

1. Field of the Invention

The field of this invention pertains to detergent compositions (class 252–89+) and detergent adjuvants thereof and processes for forming the same.

2. Description of the Prior Art

The phosphates commonly employed in detergent compositions have caused environmental pollution and it has for some time been desired to obtain detergent compositions and detergent adjuvants having reduced or no phosphate content, at reasonable costs, and the present invention aims to satisfy this want.

BRIEF DESCRIPTION OF THE DRAWINGS

In the accompanying drawing the single figure is a chart illustrating the preferred and most preferred ranges of reactants for preparing detergent adjuvant combinations of the invention.

OBJECTS AND SUMMARY OF THE INVENTION

A first object of the present invention is to provide a detergent adjuvant consisting essentially of hydrated silica pigment precipitate prepared with the aid of carbon dioxide and/or an alkali metal bicarbonate and having preferably a bound alkali content and a free alkali electrolyte content, and the latter comprising alkali metal carbonate and/or bicarbonate, such adjuvant being combined with or suitable for combination with detergents from the class consisting of soaps, synthetic anionic detergents, non-ionic detergents, polymeric anionic and non-ionic dispersants or emulsifying agents, and combinations of the same, for assisting the detergent action thereof.

A second object of the invention is to provide improved detergent compositions by combining such detergent adjuvant in never dried form with detergent material selected from the class consisting of soaps, synthetic anionic detergents, non-ionic detergents, polymeric anionic emulsifying agents and combinations of the same.

A third object of the invention is to prepare such detergent adjuvant by reacting alkali metal silicate solutions with carbon dioxide and/or alkali metal bicarbonates in the presence of an aqueous solution of detergent selected from the class consisting of soaps, synthetic anionic detergents, non-ionic detergents, polymeric emulsifying agents and combinations of the same.

In its process aspect the invention comprises a process for preparing a detergent adjuvant combination which comprises:

a. forming an aqueous solution of water soluble alkali metal silicate, b. adding to said solution sufficient reactant selected from the class consisting of carbon dioxide and alkali metal bicarbonate to form thereof a solution of electrolyte selected from the alkali metal carbonates and/or bicarbonates and having a precipitate of alkaline silica pigment therein, and

[1] Silica pigment containing bound alkali.

c. recovering said alkaline silica pigment and at least 25% dry basis, by weight, of the electrolyte resulting from step (b), in combination, as a detergent adjuvant combination.

In such three step process, step (b) may be conducted to provide said solution with electrolyte containing predetermined significant proportions of alkali metal bicarbonate, e.g. in the range of at least 2 mol percent to at least 90 mol percent thereof; the quantity of water of the solution may be reduced after the formation of the precipitate in step (b); in step (c) the recovery may include spray drying; in step (c) preferably a major part, i.e. at least 50%, and most preferably substantially all, of the electrolyte of the solution may be recovered as part of said detergent adjuvant combination; and in step (c) the detergent adjuvant combination may be mixed with detergent material selected from the class consisting essentially of the water soluble members of the following groups: Group (I) soaps; Group (II) synthetic anionic detergents; Group (III) anionic polymeric emulsifiers; Group (IV) nonionic detergents; Group (V) non-ionic polymeric emulsifiers; and combinations of two or more of said members; in a ratio in the range of 5:95 to 95:5 parts dry basis, by weight, based on the silica content as $SiO_2$; and the product recovered may be a detergent composition incorporating the detergent adjuvant combination. Furthermore, in step (c) the detergent adjuvant combination, without having been dried following step (b), may be mixed with an aqueous dispersion of the detergent material selected from the class consisting essentially of the water soluble members of said groups and combinations of said members; in a ratio in the range of 5:95 to 95:5 parts dry basis, by weight, based on the silica content as $SiO_2$; and dried therewith to form the product which may be spray dried when a powdered product is desired. In preparing the composition in step (c) detergent material selected from the sub-class consisting of the members of Groups (I), (II) and (III) may be formed in the presence of the silica pigment by reaction of the corresponding free acid with alkalinity of the combination resulting from step (b); and detergent material comprising a soap may be formed in the presence of the silica pigment by saponification of a fatty acid glyceride with the aid of alkalinity of the combination resulting from step (b). In further embodiments of the invention in step (a) the aqueous solution of water soluble alkali metal silicate may contain detergent material selected from the class consisting essentially of the water soluble members of the following groups: Group (I) soaps; Group (II) synthetic anionic detergents; Group (III) anionic polymeric emulsifiers; Group (IV) non-ionic detergents; Group (V) non-ionic polymeric emulsifiers; and combinations of two or more of said members; in a ratio 5:95 to 95:5 parts, dry basis, by weight, based on the silica content of the solution as $SiO_2$, and the product recovered may be a detergent composition incorporating the same with the detergent adjuvant combination; and in this embodiment in step (a) less than the maximum ratio of detergent to silica may be employed, and in step (c) the detergent adjuvant combination may be mixed with further detergent material selected from the members of said class and combinations thereof, in an amount which combined with that included in step (a) lies in the aforesaid ratio range.

In its product aspect the invention provides a composition comprising a detergent adjuvant combination consisting essentially of:

a. silica pigment, and
b. electrolyte,
c. said silica pigment being a wet hydrated silica pigment[1] which has been prepared by the acidulation of aqueous sodium silicate solution, preferably with the aid of reactant selected from the class consisting of carbon dioxide and the alkali metal hydrogen containing carbonates (sesquicarbonates and bicarbonates),
d. said electrolyte having been selected from the class consisting of the alkali metal carbonates and bicarbonates and combinations thereof in selected proportions,
e. said combination comprising by weight from 0.4 to 20 parts of said electrolyte per part of silica pigment, as $SiO_2$, and
f. said composition preferably having been dried;

and the electrolyte thereof may comprise alkali metal bicarbonate in predetermined significant proportions, e.g. in the range of at least 2 mol percent to at least 90 mol percent thereof.

[1] Preferably precipitated silica pigment having bound alkali.

Furthermore the composition may be in the form of a spray dried powder with the advantages of such form; and may comprise a mixture of said detergent adjuvant combination with detergent material selected from the class consisting essentially of the water soluble members of the following groups: Group (I) soaps; Group (II) synthetic anionic detergents; Group (III) anionic polymeric emulsifiers; Group (IV) non-ionic detergents; Group (V) non-ionic polymeric emulsifiers; and combinations of two or more of said members; in a ratio in the range of 5:95 to 95:5 parts dry basis, by weight, based on the silica content of the adjuvant combination as $SiO_2$; and the product may comprise hydrated silica pigment (and at least a part of said electrolyte) which has been prepared in the presence of the detergent material.

In other embodiments the product may comprise the anionic detergent formed by reacting, in the presence of the precipitated silica pigment, the water insoluble anionic detergent free acid with alkali derived in the preparation of said pigment; and the total detergent in the product may comprise at least 5 parts per 100 dry basis by weight of detergents selected from particular anionic ones of the aforesaid groups.

DESCRIPTION OF PREFERRED EMBODIMENTS

In preparing the detergent adjuvant in accordance with this invention commercially available alkali metal silicates may be employed, i.e. sodium silicates of the weight ratio $Na_2O/(SiO_2)_x$ in which the ratio of sodium oxide to silicon dioxide may range from 1:0.48 to 1:3.75 with the "soluble glass" range 1:1.6 to 1:3.75 being preferred and the most preferred range being 1:3.0 to 1:3.5, e.g. 3.22 in the 41° Be sodium silicate of commerce (see FIG. 1).

Acidulation of the sodium silicate for forming detergent adjuvant of this invention is carried out in aqueous solution with the aid of carbon dioxide and/or alkali metal bicarbonate e.g. sodium bicarbonate, and as hereinafter exemplified water soluble alkali metal salts may be included in the solution in the range of from 0 to 4 mols per mol of alkalinity of the sodium silicate as $Na_2O$, for regulating the particle size of the silica pigment product. Such salt may be recovered as part of the detergent adjuvant and when the salt so employed is alkali metal carbonate its recovery correspondingly increases the alkalinity of the adjuvant combination.

Such acidulation may be applied to alkali metal silicate solutions having concentrations of alkali metal silicate—formula $M_2O(SiO_2)_x$ in which M is alkali metal—in the range of about 20 grams per liter to about 200 grams per liter, and may be carried out at temperatures between the freezing point and boiling point of water, i.e. from about 5° C. to about 100° C. at atmospheric pressure, or up to 200° C. or more if conducted under higher pressures, and with or without the initial or timed addition of electrolyte.

The carbon dioxide gas employed in this invention may be full strength or may be diluted with air or other inert gases, e.g. such as the dilute carbon dioxide gas produced by the combustion of hydrocarbons such as propane or butane.

The process of this invention may be conducted in a batchwise or stepwise manner, or continuously, depending on available equipment.

The figure sets forth at "A" a region bounded by a, a′, a″, and a‴ in which the detergent adjuvant of this invention is preferably produced, i.e. at the bottom of the preferred range aqueous sodium silicate solution of the composition $Na_2O(SiO_2)_{1.6}$ at about 5% concentration, by weight, will form electrolyte and precipitate alkaline hydrated silica pigment when said solution has been acidified with the addition of about 0.7 to 0.8 mols of carbon dioxide (point a) and, to reduce the alkalinity of the precipitated pigment and its serum, further carbon dioxide may be added and the electrolyte sodium carbonate can be converted in whole or in part to sodium bicarbonate as indicated along line a–a′. At the top of this preferred range aqueous sodium silicate solutions of the composition $Na_2O(SiO_2)_{3.75}$ will form sodium carbonate electrolyte and precipitate alkaline hydrated silica pigment when said solution is acidified with 0.4 to 0.5 mols of carbon dioxide, as indicated at point a″. Likewise for this precipitate the alkalinity may be converted in whole or in part through sodium carbonate to sodium bicarbonate depending on the extent of carbonation as indicated along line a′′–a‴.

The size of the silica particles may be regulated by controlling during the preparation of the alkaline silica pigment the following variables: (a) composition of the sodium silicate, i.e. the ratio of $Na_2O$ to $SiO_2$; (b) concentration of the sodium silicate in the aqueous medium; (c) the quantity of added electrolyte, sodium carbonate, sodium chloride, sodium sulfate or other water soluble alkali metal salt when use of such salt is desired; (d) selection of the temperature range during acidulation of the aqueous sodium silicate solution with or without added salt or salts; (e) selection of the rate of acidulation with carbon dioxide, which acidulation rate may be constant or may be varied, e.g. in steps, during the acidulation. Thus alkaline pigment particles can be produced having a surface area in the range of 25 to 500 square meters per gram or even higher. Alkaline silica pigment particles with high surface area are especially useful as detergent adjuvants in accordance with this invention, and to adjust the feel of the adjuvant and/or the detergent composition, a combination of high surface area and low surface area alkaline silica pigments may be used.

When sodium silicate of the composition $Na_2O(SiO_2)_{3.22}$ lying in the region "B" FIG. 1, is acidulated with carbon dioxide until about 50% to 60% of the $Na_2O$ is converted to $Na_2CO_3$ then alkaline silica pigment will precipitate as $Na_2O(SiO_2)_{8.05}$ and the bound alkali will be 11.3% by weight as $Na_2O$; and if the acidulation with carbon dioxide is carried to the point where sodium bicarbonate is beginning to form in the serum at about the line b-b'' in the drawing then the bound alkali of the alkaline silica pigment precipitated will be about 2% by weight as $Na_2O$; and if the acidulation with carbon dioxide is continued until the sodium carbonate in the serum is converted to sesquicarbonate (near the line b'–b''' in the drawing) then the bound alkali of the silica pigment will be in the range of 1% by weight as $Na_2O$. When the adjuvant alkaline silica pigment precipitate is prepared from sodium silicate of the formula $Na_2O(SiO_2)_{3.22}$ treated with $CO_2$ until the precipitated silica has a bound alkali content of 2% by weight as $Na_2O$, and the resulting alkaline pigment slurry is dried without separating any of the liquor from the alkaline silica pigment slurry, the dried detergent adjuvant combination will contain bound alkali and free alkali in the amount of about 35 weight % as sodium carbonate.

Table A shows the calculated composition (dry basis) of the preferred detergent adjuvant products depending on the ratio of $Na_2O$ to $SiO_2$ in the sodium silicate solution, and the degree of carbonation effected. The quantity of sodium carbonate in the product can be varied at will and a quantity of sodium bicarbonate included if it is desirable to lower the pH, as above described.

TABLE A

| Sodium Silicate | Composition Product Weight % | | | |
|---|---|---|---|---|
| | 1 mole $CO_2$ | | 2 moles $CO_2$ | |
| $Na_2O(SiO_2)_x$ | $SiO_2$* | $Na_2CO_3$* | $SiO_2$* | $NaHCO_3$* |
| x = 0.48 | 21.2 | 78.8 | 14.6 | 85.4 |
| x = 1.6 | 47.5 | 52.5 | 36.4 | 63.6 |
| x = 3.22 | 64.6 | 35.4 | 53.5 | 46.5 |
| x = 3.75 | 68.0 | 32.0 | 57.2 | 42.8 |

*These calculated figures are on an anhydrous basis and have not been corrected for bound alkali.

The sodium silicate employed in the examples is represented by the formulation $Na_2O(SiO_2)_{3.22}$ and when an aqueous solution of about 5% by weight of this sodium silicate is acidified with one mol of carbon dioxide per mol of the sodium silicate then an alkaline, hydrated silica pigment results which has a bound alkali content of about 2% by weight as $Na_2O$ and this pigment can be represented by the following equation:

$$NaO-(Si(=O)-O)_n-Si(=O)-ONa$$

in which $n = 50.6$ and the weight ratio of $Na_2O/SiO_2$ is 2/98.

The pigment in addition to the aforesaid silica and bound alkali content has about 8% bound water which is removable by heating the pigment to 1000° C.

The sodium silicate employable herein is represented by the formula $Na_2O(SiO_2)_x$ in which x lies in the range of 0.48 to 3.5 and when such sodium silicate is acidulated with carbon dioxide until the silica pigment forms then such pigment can have a bound alkali content in range of 0.2 – 40% by weight based on the silica content of the pigment as $SiO_2$ and further the pigment can have a bound water content of about 5–15% by weight or more based on the silica content of the pigment as $SiO_2$.

In the adjuvant combination of silica and sodium carbonate and/or sodium bicarbonate and in the detergent combinations of detergent and silica and sodium carbonate and/or sodium bicarbonate the bound alkali content of the silica is essential as it provides a means of removing heavy metal ions from the water of the cleansing operation. Thus the alkali metal ion, i.e. the sodium ion of the bound alkali exchanges with the heavy metal ion, thus the more hydratable and more soluble sodium ion of the silica is replaced by the less hydratable and less soluble heavy metal ion, i.e. by the calcium or magnesium ion.

In contrast a silica pigment which has been treated with acid and/or heavy metal salt and has no residual bound alkali no longer possesses the property of being able to remove heavy metal ions from the aqueous phase and thus cannot reduce the hardness of water as such hardness may be present in the cleansing operation.

The detergent materials with which the detergent adjuvant of the present invention may be used, and which may be combined therewith to form detergent compositions of the invention, are selected from the class consisting essentially of the water soluble members of the following groups: Group (I) soaps; Group (II) synthetic anionic detergents; Group (III) anionic polymeric emulsifiers; Group (IV) non-ionic detergents; Group (V) non-ionic polymeric emulsifiers; and combinations of two or more of said members; and may be combined with the adjuvant in a ratio in the range of 5:95 to 95:5 parts dry basis, by weight, based on the silica content of the adjuvant combination as $SiO_2$.

By the term "soap" is meant the alkali metal salts, amine salts, and ammonium salts of carboxylic acids (herein termed "corresponding free acids") having from 1 to 10 carboxylic acid groups and having at least one carboxylic acid group attached to a chain of from 8 to 36 carbon atoms. Carboxylic acids meeting this definition are exemplified by the following: the fatty acids and the rosin acids and derivatives thereof, which have from 1 to 10 carboxyl groups and a chain of from 8 to 36 carbon atoms attached to at least one carboxyl group thereof, and such long-chain carboxylic acids include the individual fatty acids such as caprylic, capric, lauric, myristic, palmetic, stearic, oleic, linoleic, linolenic, abietic, hydroabietic, dehydroabietic, ricinoleic, and the like; the naphthenic acids; the mixed fatty acids derived from vegetable oils such as coconut, palm, linseed, cottonseed, soya, tung, perilla, tall, corn, oiticica, and castor oils, the mixed fatty acids derived from animal fats such as tallow fatty acids; the mixed fatty acids derived from fish oils, such as herring, menhadden, salmon and sardine oils, and the like; the dimers, trimers, and tetramers of the foregoing unsaturated fatty acids such as the dimer acids from bodied soya bean oil, the trimer acids from bodied linseed oil, and the dimers, trimers and tetramers of fish oil fatty acids; and it being understood that to employ unsaturated fatty acids set forth above to form soap usually such acids must be at least partially and preferably totally hydrogenated. The designated salt of the carboxylic acids, having from 8 to 18 carbon atoms are preferred.

By the term "synthetic detergents" is meant herein the anionic and/or non-ionic surface active agents or detergents. The anionic detergents include alkyl ($C_8$–$C_{18}$) aryl sulfonates, ethoxylated alkyl aryl sulfonates, alkyl ($C_8$–$C_{18}$) sulfates including fatty acid alcohol sulfates, alkyl ($C_8$–$C_{18}$) sulfonates, ethoxylated alcohol sulfates, alkyl and alkenyl sulfonates including α-olefin sulfonates, the alkyl i.e. the mono- or di-alkyl ($C_8$–$C_{18}$) esters of sulphosuccinic acid. The compounds hereof are employed in the form of alkaline salts, i.e., the sodium, potassium, ammonium or amine salts of the corresponding free acids, and include: sodium octyl sulphate, sodium monyl sulphate, sodium decyl sulphate, sodium undecyl sulphate, sodium dodecyl sulphate, sodium tridecyl sulphate, sodium tetradecyl sulphate, sodium pentadecyl sulphate, sodium hexadecyl sulphate, sodium heptadecyl sulphate, sodium octadecyl sulphate, sodium oleyl sulphate, sodium octyl sulphonate, sodium nonyl sulphonate, sodium decyl sulphonate, sodium undecyl sulphonate, sodium dodecyl sulphonate, sodium tridecyl sulphonate, sodium tetradecyl sulphonate, sodium pentadecyl sulphonate, sodium hexadecyl sulphonate, sodium octadecyl sulphonate, sodium oleyl sulphonate, sodium salt of di-octyl sulpho-succinate, sodium octyl benzene sulphonate, sodium nonyl benzene sulphonate, sodium decyl benzene sulphonate, sodium undecyl benzene sulphonate, sodium dodecyl benzene sulphonate, sodium tridecyl benzene sulphonate, sodium tetradecyl benzene sulphonate, sodium pentadecyl benzene sulphonate, sodium hexadecyl benzene sulphonate, sodium heptadecyl benzene sulphonate, sodium octadecyl benzene sulphonate, sodium tri (isopropyl) benzene sulphonate, sodium tri (isobutyl) benzene sulponate, sodium tri (isopropyl) naphthalene sulphonate, sodium tri (isobutyl) naphthalene sulphonate, and combinations thereof, and the like.

The "non-ionic" detergents include alkanolamides, fatty amine oxides, ethylene oxide and propylene oxide condensates of long chain fatty alcohols, alkylphenols, fatty acids, mercaptans, amides, alkanolamides, amines, and more particularly the following represented by the formula $$RCOO(\text{-}C_2H_4O)_n\text{-}H$$
$$RO(\text{-}C_2H_4O)_n\text{-}H$$
$$RS(\text{-}C_2H_4O)_n\text{-}H$$

wherein R is a 8 to 12 carbon alkyl radical and n is an integer from about 4 to 30.

It is most desirable that detergents be employed which are biodegradable, that is have essentially straight chain alkyl groups.

Among the non-ionics are the Pluronic detergents of the general formula $$HO-(C_2H_4O)_n-(C_3H_6O)_b-(C_2H_4O)_c-H$$

wherein *n*, *b*, and *c* are integers not exceeding 30.

The ethylene oxide condensation products of the alkyl phenols especially the $C_8$ to $C_{12}$ phenols as for example octylphenol, nonylphenol and dodecylphenol in which 10 to about 30 mols of ethylene oxide are condensed per mol of the phenol for example

| Phenol | ethylene oxide condensate |
|---|---|
| (Type) | (mols) |
| Nonylphenol | 9 |
| Nonylphenol | 12 |
| Dinonylphenol | 7 |
| Dinonylphenol | 15 |
| Dodecylphenol | 18 |

For further examples of alkyl and alkaryl compounds which may be condensed with alkylene oxides such as ethylene oxide, propylene oxide and butylene oxide, and for examples of these alkyl oxide condensates phosphated derivatives see for specific examples Papalos's U.S. Pat. No. 3,346,670 the examples thereof being incorporated herein by reference.

Included herein are other ethylene oxide condensate products for example dodecyl benzene sulfonamide condensed with 10 mols of ethylene oxide and decyl sulfonamide with 6 mols of ethylene oxide and the like.

Included herein are the amine oxide detergents of the general formula $R'\ R^2R^3\ N\text{-}O$ in which R′ is a radical having 8 to 28 carbon atoms and 0 to 2 hydroxy groups and 0 to 5 ether groups, $R^2$ is a $C_{10}$ to $C_{18}$ alkyl radical and $R^3$ is selected from the alkyl radicals and the hydroxylkyl radicals having 1 to 3 carbon atoms. For specific examples of the amine oxide detergents see Dean's U.S. Pat. No. 3,523,088 the examples thereof being incorporated herein by reference.

The anionic detergents include the phosphorous containing organic detergent compounds such as the phosphate esters represented by the following

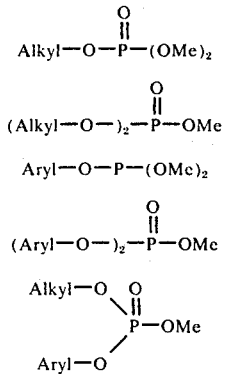

in which the alkyl has 8–7 carbon atoms and the aryl-O is a phenoxy radical or a mono-, di-, or tri-alkylphenoxy radical in which the alkyl groups have 1 to 27 carbon atoms and Me is sodium, potassium, ammonium or substituted ammonium; the such detergents further include the ethylene oxide and propylene oxide modifications of said organic phosphates as represented by the following formulae;

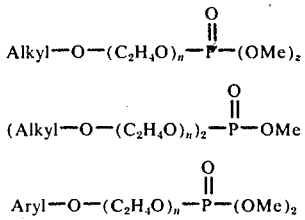

-continued

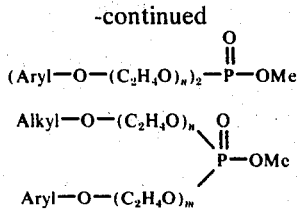

in which the alkyl and aryl group limits are defined as for the previous subclass of phosphoric acid esters, n and m are integers from 1 to 40 and Me is sodium or potassium.

Included hereunder are other phosphorous containing detergents such as the phosphonio carboxylates are described in U.S. Pat. No. 3,504,024 which are hereby incorporated by reference.

Also the phosphine oxide detergents having the formula $R' R^2 R^3$ P-O in which R' is 10 to 28 carbon atoms radical with 0 to 2 hydroxyl groups and 0 to 5 ether groups and R'' is a $C_{10}$ to $C_{18}$ alkyl groups and R is an alkyl radical or hydroxy alkyl radical with from 1 to 3 carbon atoms. For specific examples of the phosphine oxide detergents see Dean's U.S. Pat. No. 3,523,088 the examples thereof being incorporated herein by reference.

By the term "anionic polymeric dispersants" or "anionic polymeric emulsifiers" is meant polymers having organic acid groups as alkali metal salts and as such are water soluble or dispersable.

By the term "non-ionic polymeric dispersants" or "non-ionic polymeric emulsifiers" is meant polymers which are water soluble or dispersable without having organic acid and/or basic groups, the hydrophilic nature of these polymers being provided by the hydroxyl, or the like water solublizing non-ionic groups.

The term "polymeric dispersants" or "polymeric emulsifiers" as employed herein is used in a limited sense and meant to include both "anionic dispersants or emulsifiers" and/or "non-ionic dispersants or emulsifiers", however, such term excludes "cationic dispersants or emulsifiers."

Included among the polymeric dispersants or emulsifiers are those produced by mass polymerization, or solution polymerization, suspension polymerization or emulsion polymerization employing monomers yielding polymers that are water soluble or water dispersable or convertible to such form as with the aid of alkali. These polymers may be formed from hydrophilic monomers, or from mixtures of hydrophilic monomers with hydrophobic monomers, provided the quantity of hydrophobic monomer is not so high as to prevent the polymer from being, or being rendered, water soluble or dispersable. The hydrophilic monomers that may be employed alone or with other monomers, in forming polymers that are water soluble of dispersable or convertible to such form may and include the following: (1) anionic hydrophilic monomers such as those containing carboxylic, sulphonic acid or acid sulphate groups, or acid derivatives of phosphoric acid and (2) non-ionic hydrophilic monomers are those containing e.g. hydroxyl, ether, hydroxy-ester, and/or amide groups.

The polymeric dispersants or emulsifiers employed in the present invention may be prepared from one or more of the hydrophilic monomers, even polymerizing monomers of the anionic and/or non-ionic, types in the same hydrophilic polymer. Likewise the hydrophilic monomers may be polymerized with hydrophobic monomers provided the amount of hydrophobic monomer does not prevent the polymeric emulsifier from dissolving or dispersing in aqueous medium with or without the aid of a water solube base, including, for example, the alkali-metal hydroxides, bicarbonates and carbonates, and ammonia and its derivatives. The detergent compositions hereof include the water soluble or dispersable polymers in the presence of the alkaline silica and the electrolytes consisting of alkali metal carbonates and/or bicarbonates.

A variety of hydrophilic polymers can be employed as polymeric dispersants or emulsifiers especially water-soluble or water dispersible polyelectrolytes as for example those set forth in Hendrick and Mowry U.S. Pat. No. 2,625,529, and in which is described a number of materials which are synthetic water-soluble polyelectrolytes having a weight average molecular weight of at least 10,000 and having a structure derived by the polymerization of at least one monoolefinic compound through the ethylenically unsaturated group, and substantially free of cross-linking.

As polyelectrolytes Hendricks and Mowry prefer the molecular weight to be at least 10,000, however, I have found that lower molecular weights polyelectrolytes of at least 1,000 to 2,000 and even as low as 700 can be employed as polymeric emulsifiers. The said Hendrick and Mowry patent is hereby incorporated by reference.

Further, water-soluble anionic polymeric dispersants which include salts of polycarboxylic acid polymers and copolymers are referred to as polyelectrolyte builder material consisting of water-soluble salts of aliphatic polycarboxylic acid as in the patent to Diehl U.S. Pat. No. 3,308,067 which is hereby incorporated by reference.

Useful in preparing the polymeric dispersants or emulsifiers hereof is vinylidene including vinyl monomer material of the following subclasses:

Monomers with carboxyl groups which includes monobasic organic acids such as acrylic, methacrylic, cinnamic; propionic, crotonic and the like acids; dibasic acids including catonic, mesaconic, citraconic, itaconic, aconitic, fumaric, maleic and the like acids, and the half esters of the dibasic acids esterified with ethylene glycol, propylene glycol and the glycol ethers and the like;

Monomers with sulfonic groups which include styrene sulfonic acid (p-vinylbenzenesulfonic acid), toluene sulfonic acid and the like;

Monomers with hydroxyl and ester groups: the hydroxyalkyl acrylates and methacrylates which include hydroxyethyl acrylate and methacrylate, hydroxypropyl acrylate and methacrylate and the like;

Monomers with amide groups which include acylamide, N-isopropylmethacrylamide, N-methylacrylamide, N,N-diethylacrylamide, N-ethylacrylamide, N-methylmethacrylamide, N-ethylmethacrylamide, N,N-dimethylacrylamide, N,N-dimethylmethacrylamide and acrylamide and the like.

Polymers with hydrophilic groups: the polyvinyl alcohols obtained by hydrolysis of polyvinyl acetate, polyvinyl alcohol copolymers, the N-alkyl-arylamide-vinyl alcohol copolymers which can be prepared by the hydrolysis of N-alkyl-acrylamide-vinyl acetate interpolymers (see U.S. Pat. No. 2,798,047 which is incorporated herein by reference).

Vinylidene monomers with N-vinyl lactam groups such as 1-vinyl-2-pyrrolidone, 1-vinyl-5-methyl-2-pyrrolidone, 1-vinyl-3-butyl pyrrolidone, N-vinyl-5-methyl-5-ethyl pyrrolidone, N-vinyl-3,3,5-trimethyl pyrrolidone, N-vinyl-6-butyl piperidone, 1-vinyl-2-piperidone, N-vinyl-coprolactom, N-vinyl-7-ethyl-coprolactam, N-vinyl-3,5-dimethyl caprolactam, N-vinyl-4-isopropyl caprolactam, and the like;

Vinylidene monomers with ether groups such as vinyl methyl ether, vinyl butyl ether, methyl isopropenyl ether, and the like;

Other polyelectrolytes: copolymers of ethylene and maleic anhydride, copolymers, maleic anhydride and methyl vinyl ether, copolymers of styrene and maleic anhydride, hydrolized polyacrylonitrile, hydrolized polymethacrylonitrile.

It is understood that the more hydrophobic vinylidene monomers set forth herein may have to be combined with more hydrophilic monomers of those set forth herein in order to provide interpolymers which are water soluble or water dispersable.

Where the polymers including interpolymers are readily saponifiable as for example may be the case with the ester polymers then the more alkaline combinations of alkaline silica and sodium carbonate are to be minimized and the alkaline silica-sodium bicarbonate combinations are preferred.

When it is desirable to increase the hydrophobic nature of the polymers then a hydrophobic vinylidene monomer may be selected from the known vinylidene monomers and the term vinylidene monomer as used herein is meant to include vinyl monomer.

The polymerization technics for the monomers selected herein are well-known to the art as are likewise the polymerization catalysts such as, for example, the organic peroxides, e.g. benzoyl peroxide, the organic hydroperoxides, e.g. cumene hydroperoxide, the azocatalyts e.g. azo-bis-isobutyronitrile, the inorganic peroxygen compounds, e.g. potassium persulfate or hydrogen peroxide and the like.

Anionic and/or non-ionic emulsifiers may be used to prepare the polymeric detergents hereof.

The terms "dried" and "drying" herein are employed in the sense in which they are employed in the drying of soap and detergent products, i.e. the sense of removing excess water as by evaporation, spray drying, reverse osmosis or other membrane methods, for other applicable procedures, the drying being effected sufficiently to produce a commercially useful product.

The phrases "electrolyte from the class consisting of the alkali metal carbonates and bicarbonates and combinations thereof" or ". . . mixtures thereof" as understood by one skilled in the art, include mixtures of alkali metal carbonate and alkali metal bicarbonate in any proportion, and thus include but are not limited to the equimolar mixtures typified by sesquisoda which, when crystallized with two moles of water, may be termed the sesquicarbonates.

The following examples of specific embodiments of the invention are set forth to facilitate practice of the same, and are to be regarded as illustrative and not restrictive of the invention, the scope of which is more particularly pointed out and distinctly claimed hereinafter.

EXAMPLES

Example 1

This example was carried out in the following manner: to 2000 ml. of a 41° Be aqueous solution containing 4 mols sodium silicate of the composition represented by $Na_2O(SiO_2)_{3.22}$ was added 14 liters of water and placed in a precipitator vessel equipped with an agitator and the temperature thereof raised to 79° C. To this hot aqueous sodium silicate solution was gradually added 4 liters of an aqueous solution containing 4 mols of sodium carbonate and concurrently therewith but over a more extended period was added 4 mols of carbon dioxide. The time schedule of these additions is shown in Table I.

TABLE I:

| Time cumulative (min.) | Sodium carbonate Added cumulative (mols) | Acidification (mols $CO_2$ cumulative) | Acidification (percent) |
|---|---|---|---|
| 0 | — | 0 | 0 |
| 15 | — | 0.20 | 5 |
| 30 | — | 0.40 | 10 |
| 55 | 0.04 | 0.70 | 17.5 |
| 70 | 0.24 | 0.72 | 18 |
| 85 | 0.30 | 0.76 | 19 |
| 100 | 0.46 | 0.78 | 19.5 |
| 130 | 0.58 | 0.80 | 20 |
| 160 | 0.82 | 0.83 | 20.8 |
| 185 | 1.00 | 0.86 | 21.5 |
| 190 | 1.04 | 0.94 | 23.5 |
| 220 | 1.35 | 1.24 | 31 |
| 235 | 1.44 | 1.48 | 37 |
| 240 | 1.90 | 1.64 | 41 |
| 250 | 2.56 | 1.80 | 45 |
| 255 | 3.20 | 2.10 | 52.5 |
| 265 | 4.00 | 2.88 | 72 |
| 270 | — | 3.68 | 92 |
| 273 | — | 4.00 | 100 |

On spraying drying of the resulting slurry of wet precipitated alkaline silica pigment having bound alkali and free alkali therein, a detergent adjuvant having the following composition is obtained:-

| Detergent Adjuvant Composition | |
|---|---|
| Silica pigment (with 2% bound alkali) | 49%* |
| Sodium carbonate | 51%* |

*Calc. anhydrous basis.

Example 2

2a. Example 1 is repeated in pound mols and prior to drying 875 lbs. of the sodium salt of dodecyl benzene sulphonate (DDBS) is added as an aqueous solution and after thorough mixing the composition, on spray drying, yields the following product:

| Detergent Composition | Wt., lbs.* | Wt., %* |
|---|---|---|
| Sodium salt DDBS | 875 | 35.0 |
| Silica Pigment (with 2% bound alkali as $Na_2O$) | 787 | 31.6 |
| Sodium carbonate | 832 | 33.4 |
| | 2,494 | 100.0 |

* Calc. anhydrous basis.

2b. Example 1 is repeated in pound mols with the $CO_2$ addition, continued until the acidulation reaches 150% and 875 lbs. of the sodium salt of dodecyl benzene (DDBS) is then added as aqueous solution, together with 62 lbs. of carboxy methyl cellulose (CMC) and an optical brightening agent, 5 lbs., and the combination is spray dried yielding the following product:

| Detergent Composition | Wt., lbs.* | Wt., %* |
|---|---|---|
| Sodium salt of DDBS | 875 | 31.4 |
| Carboxyl methyl cellulose | 62 | 2.2 |
| Optical brightener** | 5 | 0.1 |
| Silica Pigment (with 1% bound alkali) | 780 | 27.8 |
| Sodium Carbonate | 420 | 14.9 |
| Sodium bicarbonate | 665 | 23.6 |
| | 2,807 | 100.0 |

*Calc. anhydrous basis
**Coumarin derivative

EXAMPLE 3

To a stainless steel reactor with agitator is added 1400 lbs. of water, 32.7 lbs. of dodecyl benzene sulfonate, and 4 lbs. sodium hydroxide and the mixture raised to 80° C. There is then added 310 lbs. equivalent to 200 mols $Na_2O(SiO_2)_{3.22}$ of 41 Be commercial sodium silicate solution. After thorough mixing carbon dioxide is introduced through a lead tube to the bottom of the reactor and over a period of 600 minutes 200 mols of carbon dioxide is introduced at a constant rate. On completion of the acidification with carbon dioxide the product is spray dried and has the following composition:

| Detergent Composition | Wt., lb.* | Wt., %* |
|---|---|---|
| Sodium salt of DDBS | 34.9 | 20.9 |
| Silica Pigment (with 2% bound alkali as $Na_2O$) | 85.6 | 51.3 |
| Sodium Carbonate | 46.5 | 27.8 |
| | 167.0 | 100.0 |

*Calc. anhydrous basis

EXAMPLE 4

In this example 3000 ml. of type "N" sodium silicate ($Na_2O(SiO_2)_{3.22}$) containing 6 mols of $Na_2O$ is diluted with 6 liters of water to which is added 636 g. (6 mols) of sodium carbonate dissolved in 8 liters of water at 60° C. and the combination is placed in a ceramic vessel and agitated by a 3 bladed 3 inch propeller driven 600 r.p.m. The acidulating agent consists of 908 g. (12 mols) of sodium bicarbonate dissolved in 15 liters of water at 60° C. The acidulating agent is added to the dilute sodium silicate in a controlled manner according to Table II herein.

TABLE II

| Time (minutes cumulative) | Acidulation (mols $NaHCO_3$ cumulative) |
|---|---|
| 0 | |
| 62 | 1.1 |
| 119[1] | 3.0 |
| 129 | 3.9 |
| 165 | 6.0 |
| 180 | 7.1 |
| 199 | 9.0 |
| 219 | 12.0 |

[1] Initial precipitation of silica.

The slurry of precipitated silica having bound alkali and free alkali, on drying yields a product of the following composition:

| Silica Composition | Wt. grams* | Wt., %* |
|---|---|---|
| Silica Pigment (with 2% bound alkali) | 1,182 | 48.5 |
| Sodium Carbonate | 1,236 | 51.5 |
| | 2,418 | 100.0 |

*Calc. anhydrous basis

Example 5

Example 4 is repeated, however prior to drying, the silica slurry containing bound alkali and free alkali there is added detergent paste formulated as follows:

DETERGENT PASTE FORMULATION

| Ingredients | Wt. grams |
|---|---|
| Linear dodecylbenzene sulphonate | 600 |
| Caustic Soda | 75 |
| Sodium hypochlorite | 6 |
| Oleic acid diethanolamide | 45 |
| Carboxy methyl cellulose | 75 |
| Water | 2,000 |

The combination of the wet silica slurry and the detergent paste on spray drying yields a product of the following composition:

| Detergent Composition | Wt. grams* | Wt. %* |
|---|---|---|
| Silica Pigment (with 2% bound alkali) | 1,182 | 37.5 |
| Sodium Carbonate | 1,214 | 38.5 |
| Sodium salt dodecylbenzene sulphonate | 640 | 20.2 |
| Oleic acid diethanolamide | 45 | 1.4 |
| Carboxy methyl cellulose | 75 | 2.4 |
| | 3,156 | 100.0 |

*Calc. anhydrous basis

Example 6

A 270 gallon reactor equipped with a driven 50 r.p.m. low shear stirring arm is charged with 780 liters of 80° C. water, and 65 kilos of sodium soap of tallow fatty acids is added and permitted to dissolve, followed by 144 kilos of commercial 41° Be sodium silicate containing 200 mols of the composition expressed by the formula $Na_2O/(SiO_2)_{3.22}$. The mixture is thoroughly blended with the aid of the agitator. While the solution is held at 80 ± 10° C. a submerged combustion burner[1] supplied with propane and air is ignited and submerged below the surface of the solution. The submerged combustion burner is operated at a relatively constant rate so that after 150 minutes the acidulation had progressed to 34%, i.e. 68 mols of carbon dioxide had been absorbed by the sodium silicate solution.

[1] In the examples hereof heat can be supplied by vessel heating jacket or heating coils and any source of carbon dioxide may be used.

The acidulation at 80° C. is continued for 510 minutes with the aid of the submerged combustion burner until after a total of 660 minutes the acidulation has reached 100%, i.e. 200 mols of carbon dioxide has been absorbed by the silica slurry. Throughout the formation of the silica slurry the slow speed, low shear stirrer is used, and from time to time water is added to compensate for the loss thereof due to operation of the burner.

The resulting product, when dried, has the following composition:

| Detergent Composition | Wt. Kilos* | Wt. %* |
|---|---|---|
| Silica pigment (with 2% bound alkali) | 39.4 | 31.4 |
| Sodium carbonate | 21.1 | 16.8 |
| Sodium tallow fatty acid soap | 65.0 | 51.8 |
| | 125.5 | 100.0 |

*Calc. anhydrous basis

EXAMPLE 7

To a 270 gallon reactor with stirrer is charged 680 liters of 80° C. water and 144 kilos of commercial 41° Be sodium silicate containing 200 mols of sodium silicate of the formula $Na_2O/(SiO_2)_{3.22}$ and the mixture is thoroughly blended. With the aid of a submerged combustion burner carbon dioxide is supplied to the reactor at a constant rate at a temperature of 80° C. and after 660 minutes 200 mols of carbon dioxide has been reacted with the sodium silicate solution to yield alkaline silica and sodium carbonate in the following proportions:

| Detergent Adjuvant Composition | Wt., Kilos* | Wt. %* |
|---|---|---|
| Silica pigment (with 2% bound alkali) | 39.4 | 65 |
| Sodium carbonate | 21.1 | 35 |
| | 60.5 | 100.0 |

*Calc. anhydrous basis

EXAMPLE 8

Example 7 was repeated except that the 20 kilos of dodecylbenzene sulfonic acid was replaced with 20 kilos (100% active basis) of nonyl phenol condensed with 9–10 mols ethylene oxide and the blend thoroughly mixed and spray dried and has the following composition:

| Detergent Composition | Wt. Kilos* | Wt. %* |
|---|---|---|
| Silica (2% bound alkali) | 39.4 | 48.8 |
| Sodium carbonate | 21.1 | 26.2 |
| Nonyl phenol with 9–10 molecules of ethylene oxide | 20.0 | 25 |
| | 80.5 | 100.0 |

*Calc. anhydrous basis

EXAMPLE 9

In an agitated vessel is added 1400 lbs. of water, 310 lbs. of aqueous sodium silicate containing 200 mols of $Na_2O(SiO_2)_{3.22}$ and 50 lbs. of poly(sodium styrene sulfonate) and after adequate mixing the solution temperature was raised to 75° C. Acidulation with carbon dioxide was carried out at a relative constant rate so that after 800 minutes 300 mols of carbon dioxide had been absorbed. Then was added 10 lbs. of nonyl phenol condensed with 9.5 mols ethylene oxide and after uniform mixing the blend was spray dried. The product had the following composition:

| Detergent Composition | Wt., lbs.* | Wt., %* |
|---|---|---|
| Sodium salt polystyrene sulfonate | 50 | 25 |

-continued

| Detergent Composition | Wt., lbs.* | Wt., %* |
|---|---|---|
| Alkyl phenol ethoxylate | 10 | 5 |
| Silica pigment (1% bound alkali) | 86 | 43 |
| Sodium carbonate | 21 | 10.5 |
| Sodium bicarbonate | 33 | 16.5 |
| | 200 | 100.0 |

*Calc. anhydrous basis.

EXAMPLE 10

In an agitated vessel is added 1400 lbs. of water, 310 lbs. of aqueous sodium silicate containing 200 mols of $Na_2O(SiO_2)_{3.22}$ and 30 lbs. of the sodium salt of the copolymer of vinyl methyl ether and maleic anhydride, and after blending and the temperature raised to 80° C., 200 mols of carbon dioxide was reacted over a period of 500 minutes. Then 5 lbs. of dodecylbenzene sulphonic acid sodium salt was added and the blend spray dried and the product had the following composition:

| Detergent Composition | Wt., lbs.* | Wt., %* |
|---|---|---|
| Sodium salt vinyl methyl ether maleic anhydride copolymer | 30 | 18.5 |
| Sodium salt of DDBS | 5 | 3.1 |
| Silica pigment (2% bound alkali) | 85 | 52.4 |
| Sodium carbonate | 42 | 26.0 |
| | 162 | 100.0 |

*Calc. anhydrous basis.

EXAMPLE 11

In an agitated vessel is added 1400 lbs. of water, 310 lbs. of aqueous sodium silicate containing 200 mols of $Na_2O(SiO_2)_{3.22}$, 10 lbs. trisodium phosphate*, 20 lbs. of sodium salt of polyacrylic acid and after mixing the temperature is raised to 60° C. and 300 mols of carbon dioxide absorbed over a period of 900 minutes, then is added 17.9 lbs. of alipal 233** containing 28% of the sodium salt of ethoxylated nonyl phenol sulfonate and the combination blended and dried. The product had the following composition:

** A trademark product of General Aniline Corp.

| Detergent Composition | Wt., lbs.* | Wt., %* |
|---|---|---|
| Sodium polyacrylic acid salt | 20 | 12 |
| Sodium alkyl phenol ethoxylate sulfonate | 5 | 3 |
| Silica pigment (1% bound alkali) | 86 | 51 |
| Sodium carbonate | 12 | 8 |
| Sodium bicarbonate | 33 | 20 |
| Trisodium phosphate | 10 | 6 |
| | 166 | 100 |

*The trisodium phosphate may be replaced with sodium tripolyphosphate, tetra sodium pyrophosphate, tetra potassium pyrophosphate, sodium tetra phosphate, sodium triphosphate and the like. The said phosphate salts may be added after formation of the silica.

** A trademark product of General Aniline Corp.

All above examples of detergent compositions may also be practiced with addition of conventional soap and/or detergent additives, usually in minor proportions, such as perfumes, disinfectants, bleaches, brighteners, abrasives, enzymes, solvents and oils, medicating ingredients, and the like, without departing from the invention.

While there have been described herein what are at present considered preferred embodiments of the invention, it will be obvious to those skilled in the art that modifications and changes may be made therein without departing from the essence of the invention. It is therefore understood that the exemplary embodiments are illustrative and not restrictive of the invention, the scope of which is defined in the appended claims, and that all modifications that come within the meaning and range of equivalents of the claims are intended to be included therein.

I claim:

1. A detergent adjuvant combination consisting essentially of:

a. alkaline hydrated silica pigment combined with b. electrolyte, c. said alkaline silica pigment having a surface area in the range of 25 to about 500 meters per gram and a bound alkali content of 0.2–40% by weight based on the silica content of the pigment as $SiO_2$, and having been prepared in aqueous medium by the acidulation of an aqueous solution of water soluble alkali metal silicate and having, prior to drying thereof, been combined with said electrolyte, d. said electrolyte being from the class consisting of the alkali metal carbonates and bicarbonates and combinations thereof, and being present in an amount in the range of 0.4 to 20 parts of electrolyte per part of silica pigment, as $SiO_2$, by weight and e. said combination of said electrolyte and pigment in aqueous medium having been dried.

2. A combination as claimed in claim 1, in which the electrolyte comprises both alkali metal carbonate and alkali metal bicarbonate.

3. A combination as claimed in claim 1, in which the electrolyte contains at least 10 mol percent of alkali metal bicarbonate.

4. A combination as claimed in claim 1, in which the electrolyte contains at least 30 mol percent of alkali metal bicarbonate.

5. A combination as claimed in claim 1, in which the electrolyte contains at least 50 mol percent of alkali metal bicarbonate.

6. A combination as claimed in claim 1, in which the electrolyte contains at least 90 mol percent of alkali metal bicarbonate.

7. A combination as claimed in claim 1, said combination having been spray dried.

8. An alkaline detergent adjuvant combination consisting essentially of:

a. hydrated silica pigment in combination with b. electrolyte, c. said silica pigment having a surface area in the range of 25 to about 500 meters per gram and having been prepared, together with at least a part of said electrolyte, in aqueous medium by the acidulation of an aqueous solution of water soluble alkali metal silicate with the aid of reactant selected from the class consisting of carbon dioxide and the alkali metal bicarbonate, said silica pigment having a bound alkali content in the range of 0.2–40% based on the silica of the pigment as $SiO_2$, and having, prior to drying thereof, been maintained combined with said at least a part of said electrolyte.

d. said combination including at least a part of said electrolyte resulting from the said preparation of said pigments, e. said electrolyte being from the class consisting of the alkali metal carbonates, bicarbonates and combinations thereof, and f. said electrolyte being present in the combination in an amount in the range of 0.4 to 20 parts of electrolyte per part of silica pigment, as $SiO_2$, by weight.

9. A combination as claimed in claim 8, the combination of said electrolyte and the never before dried pigment in aqueous medium having been dried.

10. An alkaline detergent adjuvant combination consisting essentially of:

a. alkaline hydrated silica pigment in combination with b. electrolyte, c. said alkaline silica pigment having a surface area in the range of 25 to about 500 meters per gram and having been prepared, together with at least a part of said electrolyte, in aqueous medium by the acidulation of an aqueous solution of water soluble sodium silicate of the formula $(Na_2O)(SiO_2)_x$ wherein x has a value of 1.5 to 3.75, with the acid of reactant selected from the class consisting of carbon dioxide and the alkali metal bicarbonates, and said silica pigment having a bound alkali content of 0.2–40% by weight based on the silica of the pigment as $SiO_2$ and having, prior to drying thereof, been combined with at least 0.4 part of said electrolyte per part of silica pigment, as $SiO_2$, dry basis, by weight, d. said combination including at least a part of said electrolyte resulting from said preparation of said pigment, e. said electrolyte being from the class consisting of the alkali metal carbonates and bicarbonates and combinations thereof, f. said electrolyte being present in the combination in an amount in the range of 0.4 to 20 parts of electrolyte per part of silica pigment, as $SiO_2$, dry basis, by weight and g. said combination of said electrolyte and never before dried alkaline pigment in aqueous medium having been dried.

* * * * *